United States Patent [19]

Pisani

[11] 4,059,874

[45] Nov. 29, 1977

[54] FABRIC CUTTING MACHINE FOR PRODUCING STRIPS FROM TUBULAR MATERIAL

[75] Inventor: Luigi Pisani, Cilavegna (Pavia), Italy

[73] Assignee: Rockwell-Rimoldi S.p.A., Milan, Italy

[21] Appl. No.: 703,990

[22] Filed: July 9, 1976

[30] Foreign Application Priority Data

July 18, 1975 Italy ..... 25541/75

[51] Int. Cl.[2] ..... B21D 43/00; B26D 3/16

[52] U.S. Cl. ..... 29/2.16; 83/733; 83/649; 83/925 CC

[58] Field of Search ..... 83/178, 180, 403.1, 83/411 R, 733, 649, 925 CC; 29/2.1, 2.11, 2.12, 2.15, 2.19, 2.22, 2.16

[56] References Cited

U.S. PATENT DOCUMENTS 3,271,838 9/1966 Pisani et al. ..... 29/2.16

*Primary Examiner*—Willie G. Abercrombie

[57] ABSTRACT

An improved fabric cutting machine for cutting tubular fabric into strip form having simplified and manually controllable adjustment devices for selectively controlling the rate of withdrawal of the tubular fabric from its source, the desired width of the strip to be cut and for synchronizing the rate of rotation of the feed means for advancing the fabric to the cutting apparatus with the rate of rotation of that portion of the machine which supports the source of tubular fabric.

3 Claims, 5 Drawing Figures

FIG. 2
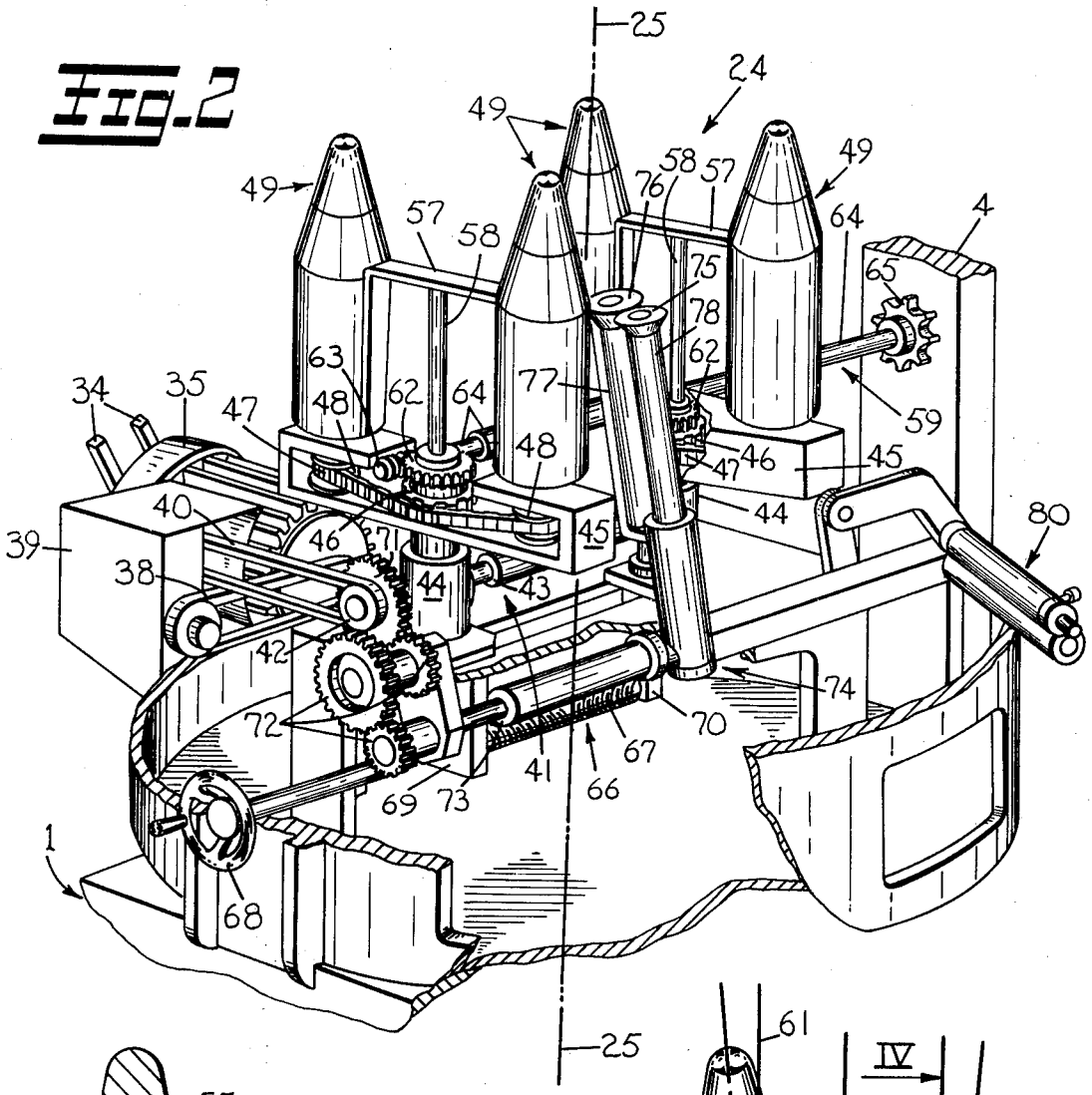
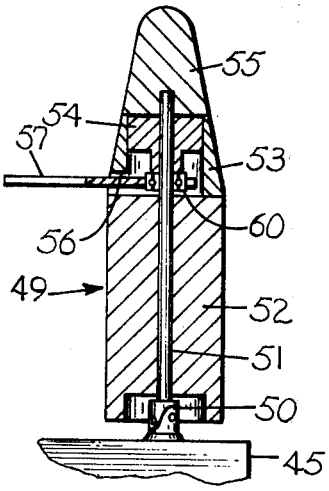
FIG. 4
FIG. 3
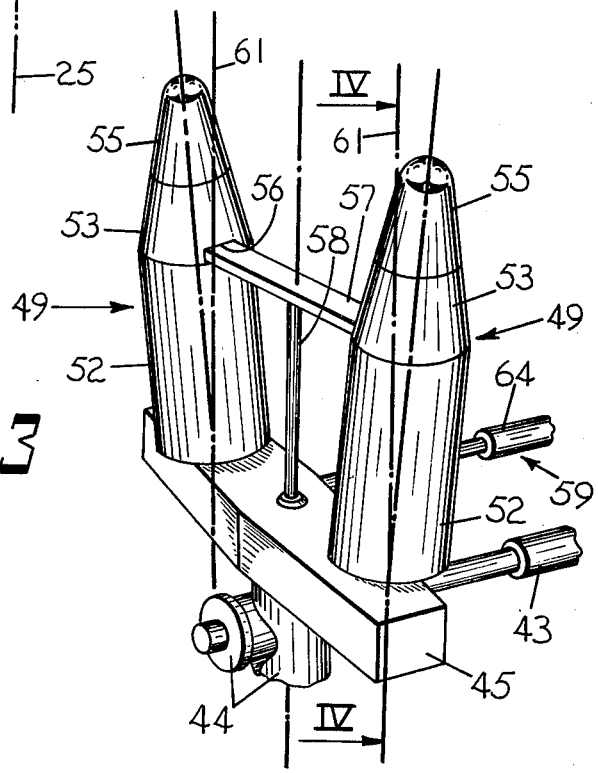

FABRIC CUTTING MACHINE FOR PRODUCING STRIPS FROM TUBULAR MATERIAL

BACKGROUND OF THE INVENTION

The present invention relates to a fabric cutting machine for producing continuous fabric strips from tubular material, more particularly, knitted material.

The conventional machines of this type have an upper frame rotatable about a vertical axis which supports the roll from which the tubular material to be cut into continuous strips of given width, is withdrawn. These machines also include a calendering device consisting of a group of parallel rollers that form a path for the tubular material and maintain it in a stretched condition while the machine is in operation. A stationary frame supports the rotatable frame and which also carries a fabric feed means located in the lower part of the machine. The feed means is rotatable and has a truncated configuration which enables it to assume a substantially cylindrical shape and effect the advance of the tubular fabric by an amount corresponding to the width of the strip of material or band to be cut.

This rotating feed means includes a drive means for effecting synchronized rotation thereof with the upper frame so as to prevent the tubular material from becoming twisted. The machines also include a cutting apparatus disposed in operative association with the base of the rotating feed means. This cutting apparatus is adapted to cut the fabric adjacent the lower edge thereof as it is advanced by the feed means and while being rotated with respect to the above mentioned vertical axis.

The rotating feed means consists essentially of a plurality of inner hinged arms supporting pressure rollers at their lower ends. which are radially disposed and which rotate freely about horizontal axes. These inner arms include means for varying their inclination and adapting the circumference on which the respective rollers are disposed so as to accommodate the size of the tubular material.

The rotating feed means also includes a plurality of outer arms which are pivotally mounted and correspond in number to the number of inner arms. At their lower ends the outer arms carry drive rollers which are supported similar to the pressure rollers against which they are yieldably urged.

The conventional machines of the above described type are extremely complicated and very difficult to regulate in order to obtain the relative speeds which must be varied according to the type of material, and more specifically, according to the particular flexibility, dimensions and width of the strip to be cut.

An object of the present invention is to provide a machine of the type described above which is of simplified construction, is easy to regulate and which will not reduce the quality of the product obtained from the machine.

SUMMARY OF THE INVENTION

The strip cutting machine according to the invention includes a stationary frame on which a feed means is supported for advancing the tubular material to be cut into strips by a cutting apparatus. It also includes a drive means for the feed means and the cutting apparatus and a frame carried thereon which is rotatable about the main axis of the machine. A drive means is provided for effecting rotation of the rotatable frame which supports the roll of tubular material to be cut into strips. A calendering device is also carried by the rotatable frame and serves as a means for guiding the tubular material as it is withdrawn from its source and advanced to the cutting apparatus. The feed means includes a plurality of rotatable stretching and feed rollers symmetrically spaced from one another and disposed substantially parallel to the main axis of the machine. A first regulating means is operatively connected to the feed means for inclining each roller with respect to the main axis which provides the means for advancing the tubular material towards the cutting apparatus and control the width of the strip to be cut. A second regulating means is also connected to the feed means and is effective in selectively varying the distance between the stretch and feed rollers and the main axis so as to maintain the advancing tubular material in a substantially cylindrical shape. The stretch and feed rollers are rotated at a constant rate by the drive means connected thereto and the rotatable frame is rotated by variable drive means which provides a means for synchronizing the rate of rotation of said rotatable frame with the rate of advance of the tubular material by said feed rollers.

The main advantage of the present invention is that of providing a substantially simplified machine which requires less maintenance, is easier to regulate and has lower operating costs than the conventional machines.

This is accomplished by the elimination of guide movement systems consisting largely of groups of cog wheels which, as is known, absorb a substantial portion of the power supplied to the machine.

This and other objects, features and advantages of the present invention will be made apparent from the following detailed description thereof which is provided with reference to the accompanying drawings in which:

BRIEF DESCRIPTION OF THE DRAWINGS

FIG. 2 is a perspective view on an enlarged scale showing further detail of a portion of the machine illustrated in FIG. 1;

FIG. 3 is a perspective view of the feed and drawing means; and

FIG. 4 is a sectional view taken along line IV-IV of FIG. 3.

DESCRIPTION OF THE PREFERRED EMBODIMENT

Figure 1:
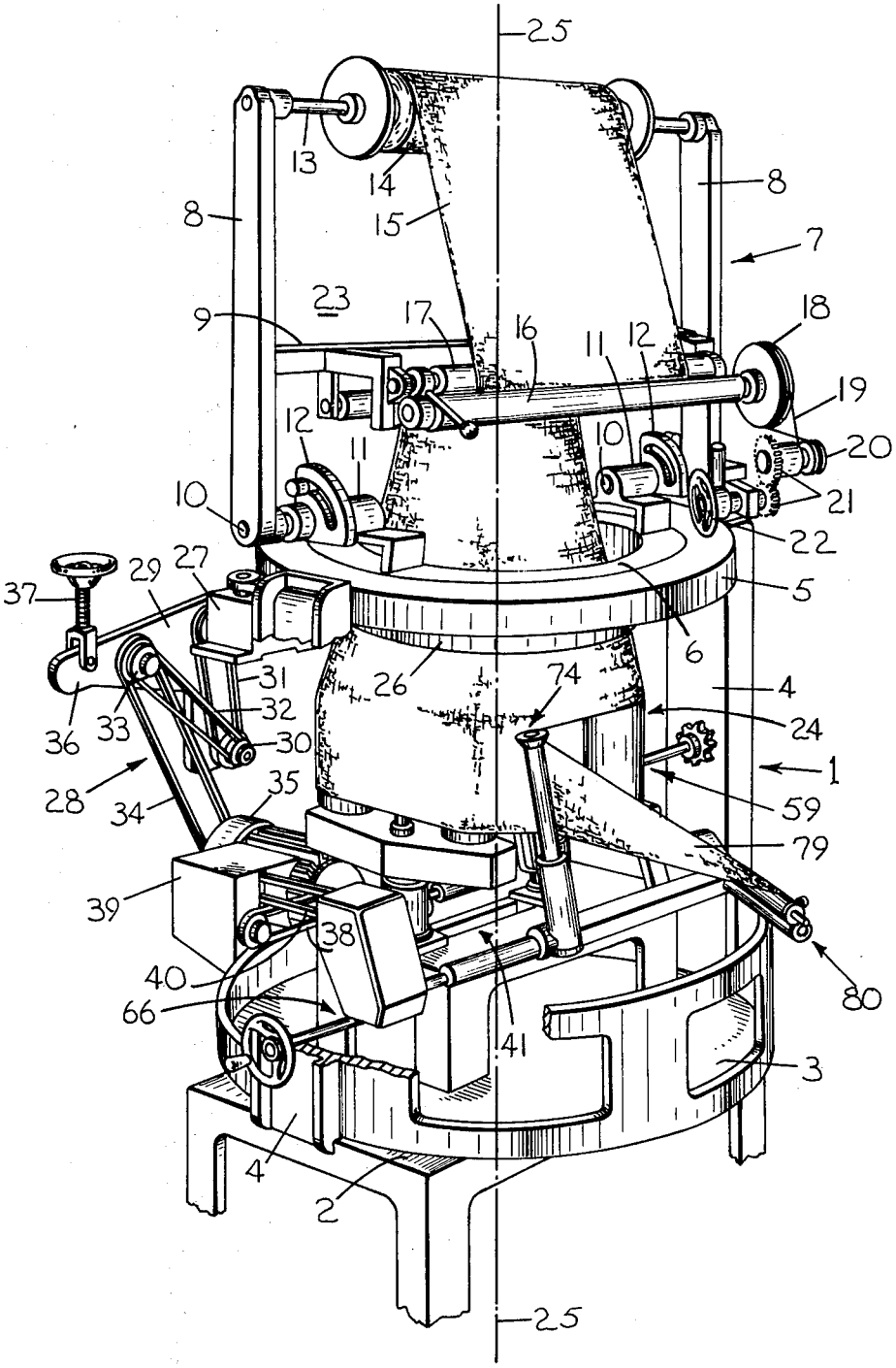
FIG. 1 is a perspective view of the machine according to the invention.

Referring now to FIG. 1, the strip cutting machine according to the invention includes a stationary frame 1 having a base 2 which carries a support surface 3. This support surface is provided with two upwardly directed and diametrically opposed uprights 4, the upper ends of which are attached to a horizontally disposed annular support 5.

This annular support 5 supports a ring 6 of a rotatable support frame 7 in a freely rotatable manner through the intermediary of suitable conical bearings (not shown). The rotating support frame 7 includes two parallel and diametrically opposed uprights 8 that are interconnected by a cross-bar 9 and is pivotably mounted on two pins 10 which are journaled in supports 11. The supports 11 are fixed to the ring 6 by any suitable means not shown and include integrally formed slotted arcuated segments 12 which enable the two uprights 8 to be pivoted with respect to the ring 6.

The rotating support frame 7 carries a bar 13 for supporting a roll 14 of tubular material 15 which serves as a source for the material being advanced to the cutting apparatus.

The cross bar 9 supports a calendering device which includes a pair of presure rollers 16 and 17 that are rotated in opposite directions by means of a driven pulley 18. This driven pulley is connected by means of a drive belt 19 to a pulley 20 which is operatively connected to a drive means 21 that is actuated by a friction wheel 22 mounted in contact with the annular support.

The pressure rollers 16 and 17 are adapted to withdraw the material 15 from the roll 14 and to direct it, after it has passed over a guide roller 23 which is rotatably supported by the cross bar 9, towards a feed means 24 mounted in the stationary frame 1.

The rotating movement of the frame 7 about the main axis 25 is effected by a pulley 26 that forms an integral part of the ring 6 and is connected by means of a drive belt (not shown) to a means for driving this rotating frame 7. This driving means includes a speed reducer 27 that is actuated by a speed varying device 28. This speed varying device 28 has a support member 29 pivotable on the axis of the speed reducer 27 which includes a double-race pulley 30 mounted adjacent the end of one of the arms that forms an integral part of said support member 29.

Pulley 30 is connected by means of a drive belt 31 to the speed reducer and by means of a belt 32 to a double-race pulley 33 mounted adjacent the end of another arm of the support member 29 and, by means of a belt 34 said pulley 33 is connected to a pulley (not shown) which is fixed on the shaft of an electric motor 35.

This pulley, which is expansible, consists of two parts which are pressed one against the other to form a race having a variable diameter between which the belt 34 is adjusted when the distance between the pulley 33 and the electric motor 35 is varied.

The arm on which the pulley 33 is mounted has an extension 36 which carries a regulating screw 37 that is pivotally mounted thereon. This regulating screw 37 is adapted to be manually turned against a part (not shown) of the stationary frame 1 and is effective is selectively changing the distance between the pulley of the motor 35 and pulley 33 so as to selectively regulate the rate of rotation of the frame 7 about the main axis 25.

The electric motor 35 is also connected by means of a drive belt 38 to another reducer 39 which transmits the rotations to a drive belt 40 to effect actuation of the drive means 41 for driving the feed and drawing means 24. Referring now to FIG. 2, the drive means 41 includes a pulley 42 fixed on one end of a telescopic shaft 43 which interconnects two drive units 44 for transmitting at 90° the rotations generated by said drive means for effecting actuation of the feed and driving means 24.

Each drive unit 44 includes a support 45 on which is mounted a transmission means which includes a toothed wheel 46 fixed on a guide shaft of the drive unit, and a drive chain 47 for forming a driving connection between the toothed wheel 46 and two toothed guide wheels 48 disposed in diametrically opposed relation to said toothed wheel 46. Each guide wheel 48 is operatively connected to a stretch and feed roller 49 mounted on the support 45 parallel to the main axis 25.

Referring now to FIG. 4, each guide wheel 48 is connected to a universal joint 50 located on the upper surface of the support 45 and carries a shaft 51 on which the stretch and feed roller 49 is mounted.

Each stretch and feed roller includes a cylinder 52 fixed on the shaft 51, an intermediate frustoconical element 53 assembled on a rotating support 54 that is fixed on said shaft 51 and a nose-shaped element 55 fixed on the upper end of said shaft 51.

The intermediate element 53 has an opening 56 which is located adjacent its base and within which is inserted one of the ends of a lever 57. This lever 57 is fixed in the region of its center portion on the upper end of a central shaft 58 which forms a part of a first regulating means 59 (FIGS. 2 and 3).

Each of the two ends of the lever 57 are pivotally connected to (FIG. 4) shaft 51 by means of a roller bearing 60 located intermediate the cylinder 52 and the rotating support 54. The universal joint 50 serves to permit the stretch and feed roller 49 to be selectively inclined with respect to the axis of rotation 61 of each guide wheel 48 which extends parallel to the aforementioned main axis 25.

The above inclination of each stretch and feed roller 49 serves to produce a withdrawing force on the tubular fabric during rotation of the rollers. This withdrawing force is directed parallel to the main axis 25 and the tubular fabric 15 being wrapped about the rollers is caused to move downwardly while being withdrawn from its source on the support frame 7.

This inclination is controlled by the first regulating means 59 which, in addition to the lever 57 and the central shaft 58 mounted parallel to shafts 51 on the support 45, also includes a worm wheel 62 fixed on the central shaft 58 and engaged by a worm gear 63 fixed on a telescopic shaft 64. This telescopic shaft 64 projects from the support and feed means 24 and includes a hand-wheel 65 to enable it to be rotated manually.

By virtue of the fact that the coupling between the lever 57 and the shaft 51 consists of a conventional roller bearing 60, said shaft 51 can obtain a specific rotational inclination from the lever 57 according to the particular reciprocal adjustment of the component parts of this roller bearing.

Each lever 57 interconnects two stretch and feed rollers 49 which are symmetrically positioned with respect to the central shaft 58. As a result, by selectively rotating the hand-wheel 65, the lever 57 will be rotated at right angles to the main axis and thus in the same direction of rotation as the tubular material and consequently the stretch and feed rollers 49 will be inclined in opposite directions to one another, as shown in FIG. 3.

The support and feed means 24 also includes a second regulating means 66 (FIG. 2) for varying the distance between the supports 45 and thus between the stretch and feed rollers 49 carried by said supports.

It is necessary for the supports 45 to be symmetrically adjusted with respect to the main axis 25 in order to sufficiently stretch the tubular material with respect to its perimeter and thus facilitate the strip cutting operation. The second regulating means 66 includes a drive screw 67 having oppositely directed feed threads and a hand-wheel 68 for effecting manual rotation of said drive screw. The drive screw 67 is operatively associated with two opposed sector 69 and 70, each of which is engaged with one of the threads and interconnected with one of the drive units 44.

A toothed wheel 71 is fixed on and adjacent one end of the telescopic shaft 43 of the drive means 41. This toothed wheel 71 is adapted to transmit the rotations of the pulley 42 to a train of gears 72 which are operatively connected to a telescopic shaft 73 that is adapted to control the cutting means 74. This cutting means 74 is provided with a conventional rotatable disk blade 75 and an associated idler disk 76.

The idler disk 76 is rotatably carried on a support arm 77 located parallel to and spaced from a support arm 78 for the disk blade 75 and serves as a means for guiding the strip 79 (also see FIG. 1) cut from the material towards a conventional wind-up device 80.

MODE OF OPERATION OF THE MACHINE

In the case of strip cutting machines, to obtain a strip of material, it is firstly necessary to open the tubular material and give it a more or less cylindrical shape so that it can be cut circumferentially with a helicoidal course of passage corresponding to the desired width.

To achieve this, the tubular material is unwound from the roll 14 and passed between the rollers 16 and 17 of the calendering device and then over the guide roller 23.

From the guide roller 23 the tubular material is slipped about the feed and drawing means 24 so that it is adequately stretched out when presented to the cutting means 74. The tensioning of the tubular material is obtained by increasing the space between the pairs of stretch and feed rollers 49 by selectively rotating the hand-wheel 68. The tubular material should be slid onto the feed and drawing means 24 until it substantially covers the cylinders 52. he cylinders 52 are covered with a material having wear resistant qualities which serve to facilitate drawing of the tubular material without relative slippage and they are adapted to cause the material to move in a direction parallel to the main axis and to make it advance beyond the cutting means by an amount corresponding to the desired width of the strip 79 to be cut. The width of the strip to be cut depends on the degree of inclination of the stretch and feed rollers 49.

The nose-shaped elements 55 serve to effect rotation of the tubular material about the main axis 25 so that a new section of material is constantly presented to the cutting means, while the intermediate frustoconical elements 53 are adapted to spread out the material before it reaches the cylinders 52.

The rotating disk blade 75 is located in the area adjacent to the top part of a cylinder of one of the stretch and feed rollers 49 so as to have a sufficiently broad surface extension capable of providing a larger range of possible widths for the strips. The width of a strip corresponds to the distance between the cutting means and the lower edge of the tubular material.

As the rate of rotation of the stretch and feed rollers 49 is constant, it is necessary to synchronize the rotation of the rotating frame 7 with the rotation of the tubular material by the rollers 49 so as to prevent the material from becoming twisted. To synchronize the aforementioned movements in this way it is sufficient to manipulate the regulating screw 37 which causes the support member 29 to be rotated with the consequent movement of the pulley 33 towards or away from the electric motor 35. This latter movement in turn, produces an increase or reduction in the speed of the pulley 33.

As a result, the rate of rotation of the rotating frame 7 is either increased or reduced.

It should be understood that the number of stretch and feed rollers 49 which includes four in the embodiment illustrated, can be reduced, for example, to three or two, provided that the contact surface of the tubular material is substantially constant over all the rollers.

I Claim:

1. A strip cutting machine of the type having a stationary frame with a support frame mounted thereon for rotation about the axis of the machine and for supporting a source of tubular fabric to be cut into strip form by a cutting apparatus carried on the stationary frame, said strip cutting machine comprising:

a. feed means (24) connected to the stationary frame which includes a plurality of rotatably driven stretch and feed rollers (49) radially spaced from and extending substantially parallel to the axis of the machine;

b. a first regulating means (59) operatively connected to said feed means for selectively inclining each of said stretch and feed rollers simultaneously relative to the axis of the machine to produce a withdrawing force on the tubular fabric and direct the same toward the cutting apparatus;

c. means defining a second regulating means (66) connected to said feed means for varying the distance between said stretch and feed rollers (49) and the axis of the machine for maintaining a substantially cylindrical configuration of the fabric while it is being advanced to the cutting apparatus; and d. variable drive means operatively associated with said feed means for sychronizing the rate of rotation of said feed means (24) with the rate of rotation of the support frame.

2. The strip cutting machine according to claim 1 wherein said feed means includes a support (45) for supporting each pair of said stretch and feed rollers in spaced relation and a gear actuated lever (57) interconnecting each pair of said stretch and feed rollers for effecting their inclination in opposite directions by said first regulating means.

3. The strip cutting machine according to claim 2 wherein said second regulating means includes manually operable gear controlled linkage interconnecting said supports (45) for effecting selective movement thereof toward and away from the axis of the machine.

* * * * *